United States Patent [19]

Booty

[11] 4,286,397

[45] Sep. 1, 1981

[54] SKI BOOT WALKING ACCESSORY

[75] Inventor: Donald J. Booty, Frankfort, Ill.

[73] Assignee: Snow Biz, Inc., Chicago, Ill.

[21] Appl. No.: 113,072

[22] Filed: Jan. 17, 1980

[51] Int. Cl.[3] ..... A43B 5/00; A43D 5/00

[52] U.S. Cl. ..... 36/132; 12/120.5

[58] Field of Search ..... 36/117, 132; 12/120.5

[56] References Cited

U.S. PATENT DOCUMENTS

| | | | |
|---|---|---|---|
| 4,156,316 | 5/1979 | DeFever | 36/132 |
| 4,160,301 | 7/1979 | Woolley | 36/132 |

FOREIGN PATENT DOCUMENTS

| | | | |
|---|---|---|---|
| 2617257 | 1/1977 | Fed. Rep. of Germany | 36/132 |
| 573729 | 3/1976 | Switzerland | 36/132 |

*Primary Examiner*—Patrick D. Lawson

*Attorney, Agent, or Firm*—Trexler, Bushnell & Wolters, Ltd.

[57] ABSTRACT

The present invention provides apparatus attachable to an Alpine ski boot for aiding the wearer in walking. This apparatus comprises an auxiliary sole attachable under the sole of the ski boot and having an upper surface for accommodating the ski boot sole and a lower surface for engaging the ground. A given curvature is provided on the lower surface for approximating the normal heel-to-toe walking motion. A pocket in a leading end portion of the auxiliary sole surroundingly engages a toe portion of the ski boot sole. An elongate, elastically deformable cord grippingly engages the heel portion of the ski boot. This cord has a pair of studs attached to its respective ends. A plurality of stud-engaging slots are spaced at predetermined intervals longitudinally of the auxiliary sole for releasably engaging these studs to provide a range of adjustment of the effective length of the unstressed cord.

11 Claims, 5 Drawing Figures

SKI BOOT WALKING ACCESSORY

BACKGROUND OF THE INVENTION

This invention relates generally to sporting accessories, and more particularly to an auxiliary sole apparatus attachable to an Alpine ski boot for aiding the wearer in walking.

In Alpine or downhill skiing, it is customary to provide a ski boot which has a relatively flat, rigid and inflexible sole. Moreover, these boots generally are designed to surroundingly engage the ankle of the wearer so as the discourage the normal heel-to-toe walking motion. This is, the boot is generally designed to provide a rather rigid ankle support. Consequently, normal walking while wearing such boots is relatively difficult and uncomfortable.

In the normal course of ski activity, however, there are many instances in which the skier will wish to remove his skis in order to walk, while still wearing these ski boots.

Prior art devices for this purpose have not heretofore addressed several of the problems encountered in the practical use of such a walking accessory. For example, it is desirable to approximate the normal heel-to-toe motion of the foot in walking, in order to provide a reasonably comfortable gait when utilizing the walking accessory on a ski boot. Additionally, it is desirable that the device be relatively simple to both apply to and remove from the ski boot, but remain reliably in place once attached or applied for walking purposes.

Moreover, the provision of ready and simple adjustability of such an apparatus to accommodate ski boots of different sizes and configurations is a desirable feature not found in many prior art devices. Some consideration also needs to be given to the ease of storage and transport of the device while the wearer is skiing or when the device otherwise is not in use.

In addition to the foregoing, it is also desirable that such a device be relatively simple in design and comprise as few parts as possible so as to be relatively simple and inexpensive to manufacture and assemble, as well as being relatively easy to use.

OBJECTS AND SUMMARY OF THE INVENTION

Accordingly, it is an object of the present invention to provide new and approved apparatus attachable to an Alpine ski boot for aiding the wearer in walking.

A more specific object is to provide a new and improved ski boot walking aid apparatus which provides a heel-to-toe curvature at its bottom or ground-engaging surface to simulate a natural walking motion.

A further object is to provide apparatus in accordance with the foregoing objects which is relatively simple to attach to and remove from a ski boot, while reliably and firmly remaining in place once attached.

Yet another object is to provide a ski boot walking accessory in accordance with the foregoing objects which is adapted to be readily and simply transported and stored in pairs when not in use.

A related object is to provide a ski boot walking accessory in accordance with the foregoing objects which is readily adjustable for use with a relatively broad range of boot types and sizes.

Briefly, and in accordance with the foregoing objects, the present invention provides apparatus attachable to an Alpine ski boot for aiding the wearer in walking. In accordance with the invention, this apparatus comprises auxiliary sole means attachable under the sole of the ski boot and having an upper surface for accommodating the ski boot sole and a lower surface for engaging the ground, means for defining a curvature on the lower surface of the auxiliary sole mans, pocket means at a leading end portion of the auxiliary sole means for surroundingly engaging a toe portion of the ski boot sole and elastically deformable cord means for grippingly engaging a heel portion of said ski boot.

BRIEF DESCRIPTION OF THE DRAWINGS

The foregoing, as well as other objects, features and advantages of the present invention will be more readily appreciated upon reading the following description of the illustrated embodiment, together with reference to the accompanying drawings, wherein.

DETAILED DESCRIPTION OF THE ILLUSTRATED EMBODIMENT

Figure 1:
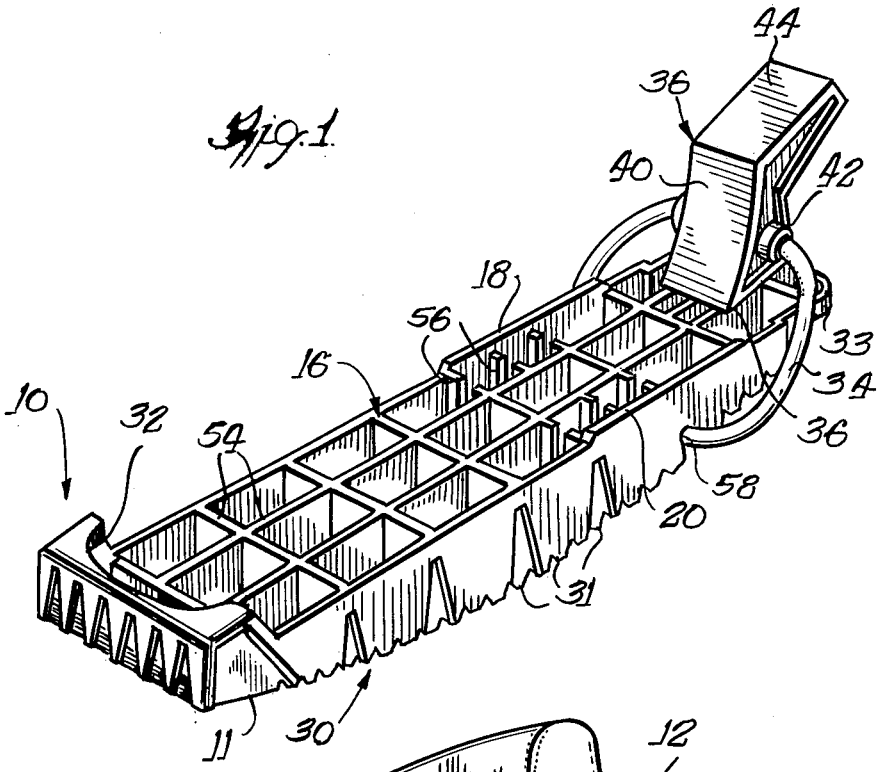
FIG. 1 is a top perspective view of ski boot walking accessory apparatus in accordance with the present invention.
Figure 2:
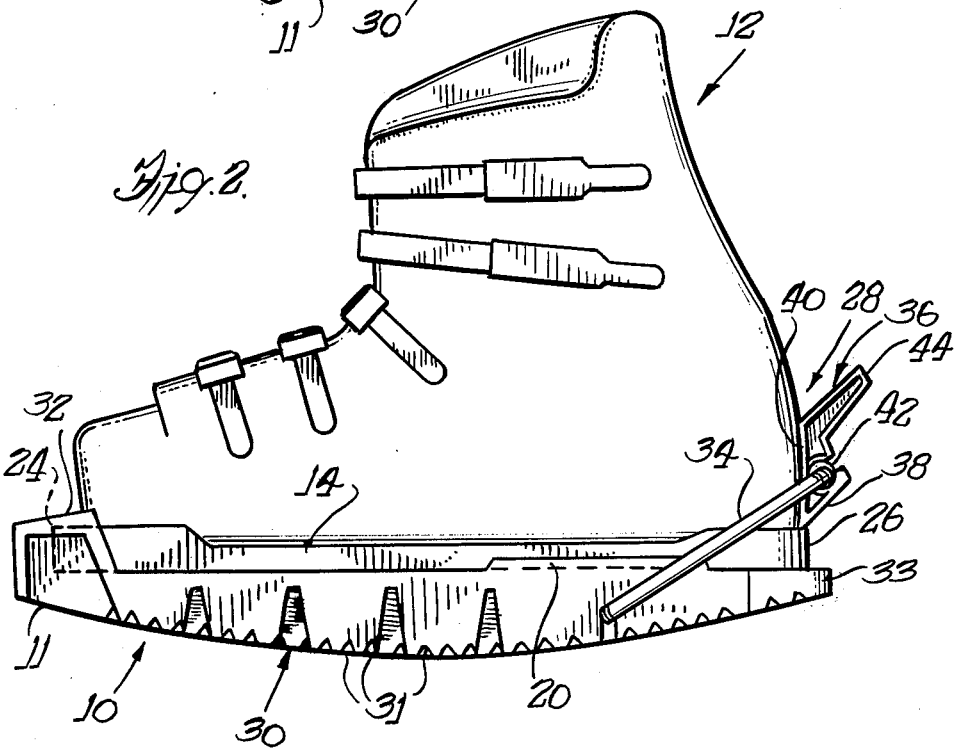
FIG. 2 is a side elevation of the apparatus of FIG. 1 attached to a typical Alpine ski boot.

Referring now to the drawings, and initially to FIG. 1 and FIG. 2, a ski boot walking accessory in accordance with the present invention is designated generally by the reference numeral 10. The apparatus 10 is illustrated in FIG. 2 attached to a typical Alpine ski boot designated generally by the reference numeral 12. Generally speaking, the apparatus 10 comprises an auxiliary sole 11 attachable under the sole 14 of the ski boot 12 and having an upper surface 16 which generally defines a flat plane for accommodating the relatively flat bottom surface of the ski boot sole 14. A pair of side support walls or members 18, 20 extend somewhat above the plane defined by the upper surface 16 of the apparatus 10. These side walls 18 and 20 engage a minor fractional part of the side surfaces of the ski boot sole 14, to ensure substantial horizontal centering of the ski boot 12 upon the apparatus 10.

Referring for a moment to the ski boot 12, it will be seen that the sole 14 typically includes slightly protruding toe and heel portions 24, 26. Additionally, the rear or heel portion of the boot 12 exhibits some degree of curvature as it extends upwardly from its joining point with the boot sole 14, as indicated generally at reference numeral 28.

Referring now to the walking accessory 10, the auxiliary sole 11 also includes a bottom surface, designated generally by the reference numeral 30, which is provided with a suitable thread surface 31 (seen best in FIG. 4) for positive engagement with ice, snow or the like which is commonly encountered on the ground surfaces in and about the skiing area.

In accordance with one feature of the invention, the bottom surface 30 of the auxiliary sole 11 defines a curvature from heel to toe, for approximating the motion of the foot during normal walking. Since a typical ski boot, such as the boot 12 greatly restricts the normal walking motion of the foot, due to its fairly rigid construction, this substitute motion is most advantageous in aiding walking when the skier is wearing the boot 12.

In accordance with a further feature of the invention, the auxiliary sole 11 carries a pocket 32 in its leading or toe end portion which is advantageously formed for surroundingly engaging the protruding toe portion 24 of the ski boot 12. Cooperatively, and in accordance with yet a further feature of the invention, a flexible or stretchable cord 34 is also provided for grippingly engaging the heel part 28 of the boot 12, generally above a heel end portion 33 of the auxiliary sole 11. Consequently, the boot 12 is held in positive engagement with walking accessory 10 by the cooperative action of the toe-engaging pocket 32 and the heel-engaging flexible cord 34.

In accordance with a preferred embodiment of the invention, the flexible cord 34 is further provided with a cam or pawl member 36 for engagement with the back or heel surface 28 of the ski boot 12. Advantageously, the pawl member 36 includes a pawl-end 38 which defines a relatively acutely angled portion for engagement generally at the junction of the ski boot back portion 28 with the heel portion 26 of the ski boot sole 14. A heel-engaging face 40 of the pawl number 36 is formed with a curvature to generally conform to the curvature of the back or heel part 28 of the ski boot 12.

In accordance with a preferred embodiment, the pawl number 36 includes a semi-circular groove or cut-out 42 for pivotal mounting thereof to the cord 34. The pawl member 36 further includes a protruding release tab portion 44 to facilitate release thereof by the wearer.

Briefly, the stretchable cord 34 will be seen to cooperate with the pawl member 36 for ensuring positive gripping or locking engagement in a pawl-like fashion with the ski boot 12. Advantageously, however, the pawl 36 may be easily removed from this locking pawl-like engagement by generally downward pressure, by the wearer, upon the outwardly extending release tab portion 44.

Figure 3:
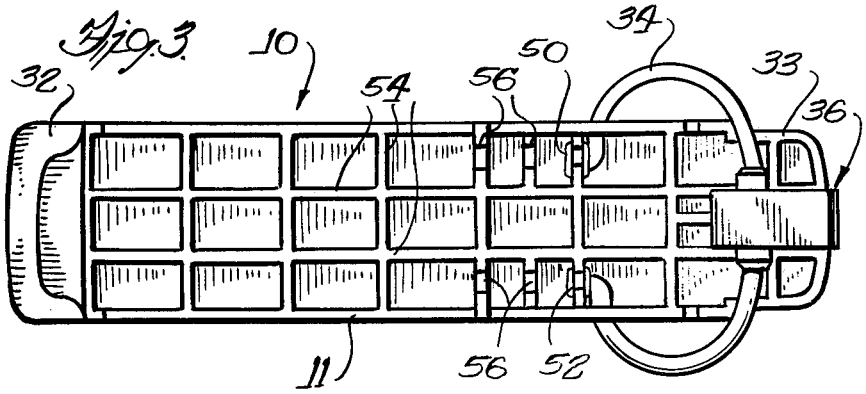
FIG. 3 is a top view of the apparatus of FIG. 1.
Figure 4:
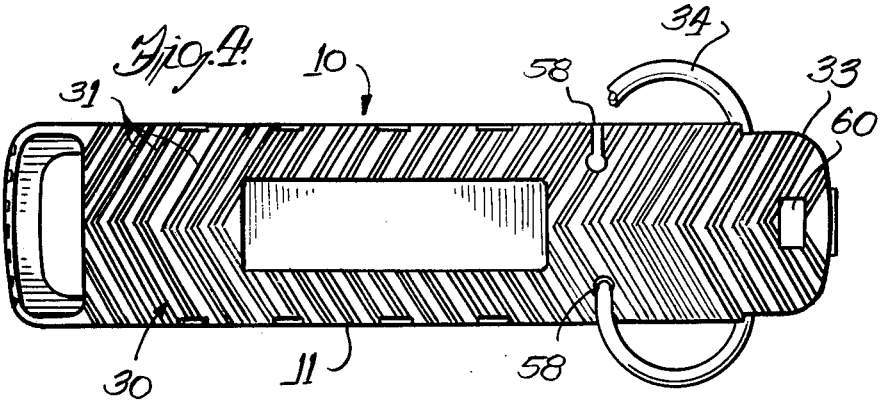
FIG. 4 is a bottom view of the apparatus of FIG. 1.

Referring now also to FIG. 3 and FIG. 4, the adjustable nature of stretchable cord 34 will now be illustrated and described. In accordance with a preferred embodiment, the cord 34 comprises an elastically deformable material for use with boots over a fairly broad range of types and/or sizes. Additionally, as best seen in FIG. 3, the cord 34 comprises a single, elongate cord having two ends, the pawl member 36 being substantially centrally mounted thereon. Each of the ends of cord 34 is provided with a stud member 50, 52.

The auxiliary sole 11 is primarily hollow in its interior, but is provided with a plurality of strengthening partitions, designated generally by the reference numeral 54. A number of these partitions 54, located at longitudinally spaced intervals along the apparatus 10 are provided with slots or apertures 56 for removably receiving the studs 50, 52. Accordingly, it will be seen that the unstressed length of the cord 34 may be varied by varying the mounting locations of the studs 50, 52 among the various slots 56.

Referring to FIG. 4, a pair of keyhole-like entryways or slots 58 are provided generally at the junction of the bottom and side surfaces of the auxiliary sole member 11 for receiving the cord 34. These slots permit entry of the cord 34 for the attachment of studs 50, 52 to the chosen slots 56, without interferring with the bottom surface 30 of auxiliary sole 11.

In accordance with a preferred form of the invention, a through aperture 60 is provided near the back or heel portion of the auxiliary sole 11 to receive a cable or the like for holding or securing the walking accessory when not in use.

Figure 5:
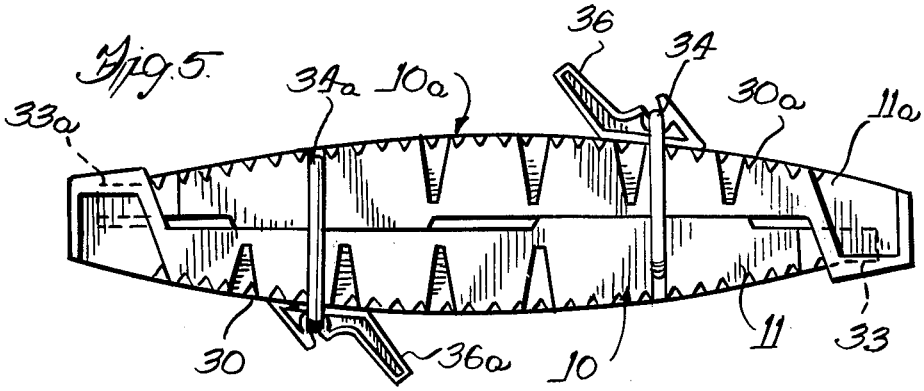
FIG. 5 is a side elevation of a pair of ski boot walking accessories in accordance with the invention joined together for storage and/or transport.

Additionally, and referring to FIG. 5, a pair of walking accessories 10 may be conveniently mounted together for storage and/or transport. Briefly, a pair of walking accessories **10, 10*a* according to the invention may readily be placed with their top surfaces 16 in facing relation, and in heel-to-toe configuration. The trailing or heel end portion 33*a* of the walking accessory 10*a* readily interfits with the pocket 32 formed in the toe portion of accessory 10 and vice versa, to facilitate the interengagement of the walking accessories 10 and 10*a*. The respective cords 34, 34*a* and their cooperating pawl members 36, 36*a* may also be elastically engaged over the opposite bottom surfaces 30*a*, 30**.

While the present invention has been illustrated and described with reference to a preferred embodiment, the invention is not limited thereto. On the contrary, those skilled in the art may devise various changes and modifications, and the present invention is intended to embrace such changes and modifications, insofar as they fall within the spirit and scope of the appended claims.

The invention is claimed as follows:

1. Apparatus attachable to an Alpine ski boot for aiding the wearer in walking, said apparatus comprising: auxiliary sole means attachable under the sole of the ski boot and having an upper surface for accommodating the ski boot sole and a lower surface for engaging the ground, means for defining a curvature on the lower surface, rigid pocket means in a leading end portion of said auxiliary sole means for surroundingly engaging a toe portion of the ski boot sole, elastically deformable cord means coupled to said auxiliary sole means and pawl means carried on said elastically deformable cord means for grippingly engaging a heel portion of said ski boot.

2. Apparatus according to claim 1 wherein said ground-engaging lower surface of said auxiliary sole defines a predetermined radius of curvature from toe to heel.

3. Apparatus according to claim 1 wherein said lower surface is further provided with tread means for engaging snow, ice or the like upon the ground.

4. Apparatus according to claim 1 further including means for varying the unstressed length of the elastically deformable cord means.

5. The apparatus according to claim 4 wherein said elastically deformable cord means comprises an elongate cord having a pair of ends, wherein the cord length varying means comprises a pair of stud means attached to the respective cord ends and a plurality of stud-engaging means spaced at predetermined intervals longitudinally of the auxiliary sole means for releasably engaging said stud means.

6. The apparatus according to claim 5 wherein the auxiliary sole means has a substantially hollow interior portion and passageway means for permitting entry of the elastically deformable cord and end-mounted stud means thereon into said interior hollow portion, and wherein said stud-engaging means comprises a plurality of partitions bearing stud-engaging slots formed in said substantially hollow interior portion and spaced at predetermined intervals along said hollow interior portion of the auxiliary sole.

7. The apparatus according to claim 1 wherein said pawl means includes a boot-engaging surface having a predetermined curvature for closely engaging a predetermined portion of the back side of the ski boot, said boot-engaging surface terminating in an acutely angled end portion of said pawl means, said end portion engaging said ski boot substantially at the junction of the heel end of the sole of said ski boot with said back side of said ski boot.

8. The apparatus according to claim 1 wherein the trailing heel end portion of said auxiliary sole means is of similar dimension to the interior of the pocket means thereon, whereby a pair of said auxiliary sole means may be releasably engaged in toe-to-heel fashion to facilitate storage and transport of a pair of said auxiliary sole means.

9. The apparatus according to claim 1 wherein said auxiliary sole means has a through aperture adjacent the heel portion thereof for receiving means for securing said auxiliary sole means during storage or transport thereof.

10. The apparatus according to claim 7 wherein said pawl means further includes means for pivotal mounting thereof with respect to said elastically deformable cord means and outwardly extending release tab means for initiating pivotal motion of said pawl with respect to said elastically deformable cord means, thereby facilitating release of said pawl means by the wearer.

11. Apparatus attachable to an Alpine ski boot for aiding the wearer in walking, said apparatus comprising: auxiliary sole means attachable under the sole of the ski boot and having an upper surface for accommodating the ski boot sole and a lower surface for engaging the ground, means for definig a curvature on the lower surface, rigid pocket means in a leading end portion of said auxiliary sole means for surroundingly engaging a toe portion of the ski boot sole, an elongate, elastically deformable cord for engaging over a heel portion of said ski boot, said cord having a pair of cord ends, a pair of stud means attached to the respective cord ends, a plurality of stud-engaging means spaced at predetermined intervals longitudinally of the auxiliary sole means for releasably engaging said stud means to adjust the unstressed length of said elastically deformable cord and a pawl rotatably mounted on said elastically deformable cord for grippingly engaging a heel portion of said ski boot.

* * * * *